US008962089B2

(12) United States Patent
Schmidt et al.

(10) Patent No.: US 8,962,089 B2
(45) Date of Patent: Feb. 24, 2015

(54) METHOD FOR THE FLOW COATING OF A POLYMERIC MATERIAL

(75) Inventors: Sebastian Schmidt, Stuttgart (DE); Thomas Tschurl, Salach (DE); Juri Zerr, Winnenden (DE)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 13/697,818

(22) PCT Filed: Jun. 6, 2011

(86) PCT No.: PCT/EP2011/059311

§ 371 (c)(1), (2), (4) Date: Apr. 23, 2013

(87) PCT Pub. No.: WO2011/157586

PCT Pub. Date: Dec. 22, 2011

(65) Prior Publication Data

US 2013/0202799 A1 Aug. 8, 2013

(30) Foreign Application Priority Data

Jun. 14, 2010 (EP) ..... 10165849

(51) Int. Cl.

| | |
|---|---|
| ***B05D 1/30*** | (2006.01) |
| ***B05D 3/04*** | (2006.01) |
| *B05D 7/00* | (2006.01) |
| *B05D 7/02* | (2006.01) |

(52) U.S. Cl.

CPC ... *B05D 1/30* (2013.01); *B05D 7/54* (2013.01); *B05D 7/02* (2013.01); *B05D 3/0413* (2013.01); *B05D 3/042* (2013.01)

USPC ..... 427/348; 427/316; 427/420; 427/407.1

(58) Field of Classification Search

CPC ..... B05D 1/3005

USPC ..... 427/348, 420, 407.1

See application file for complete search history.

(56) References Cited

U.S. PATENT DOCUMENTS

| | | | | |
|---|---|---|---|---|
| 2004/0138399 | A1* | 7/2004 | MacKinnon et al. | 528/31 |
| 2005/0079291 | A1* | 4/2005 | Fyen et al. | 427/346 |
| 2006/0127796 | A1* | 6/2006 | Obata et al. | 430/130 |
| 2008/0280060 | A1* | 11/2008 | Beaudoin et al. | 427/487 |

FOREIGN PATENT DOCUMENTS

| | | |
|---|---|---|
| WO | 2008 134768 | 11/2008 |

OTHER PUBLICATIONS

International Preliminary Report on Patentability and Written Opinion issued Dec. 14, 2012 in PCT/EP2011/059311 filed Jun. 6, 2011.

U.S. Appl. No. 13/640,164, filed Oct. 9, 2012, Tschurl, et al.

International Search Report Issued Aug. 10, 2011 in PCT/EP11/59311 Filed Jun. 6, 2011.

* cited by examiner

*Primary Examiner* — Nathan T Leong

(74) *Attorney, Agent, or Firm* — Oblon, Spivak, McClelland, Maier & Neustadt, L.L.P.

(57) ABSTRACT

Method for flow coating a polymeric material, wherein a. at least one component (1) is inserted at an angle of 25° to 90° relative to the floor (5) into a holder (2), and b. the component (1) is coated from the upper edge (1*a*) with a varnish (3), containing 10 wt.-% to 30 wt.-% of 4-methyl-2-pentanone and/or derivatives thereof.

16 Claims, 4 Drawing Sheets

METHOD FOR THE FLOW COATING OF A POLYMERIC MATERIAL

Figure 1:
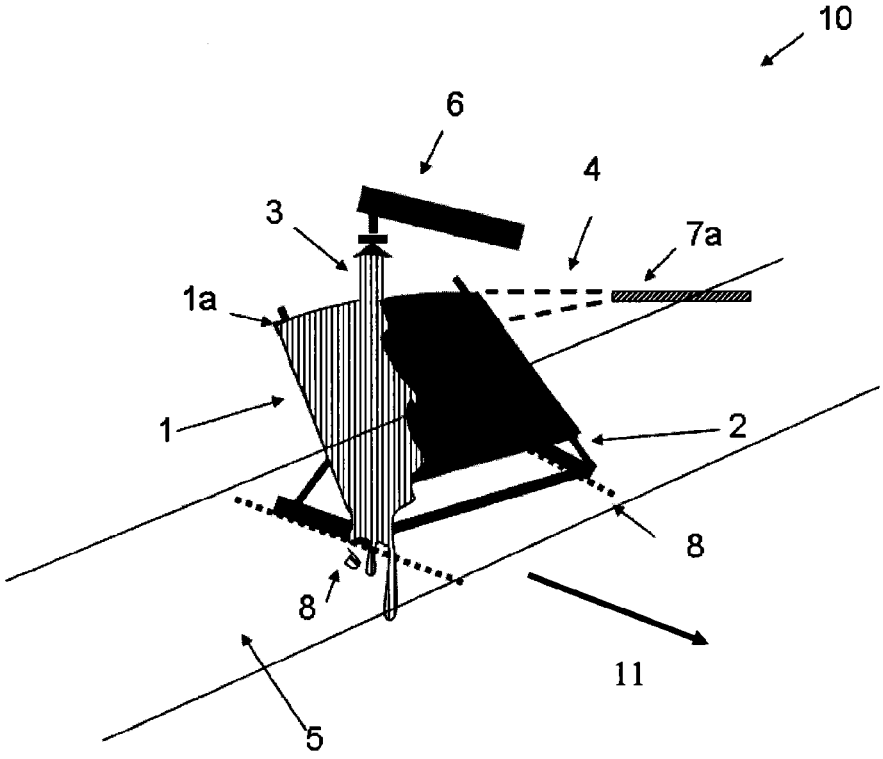

The invention relates to a method and a device for flow coating a polymeric material.

Coating and varnishing have, in addition to visual appearance, a substantial effect on the surface quality and resistance of a polymeric material. This concerns both the visual impression, such as the color or the sheen, of the polymeric material and its chemical and mechanical resistance. If the varnish adheres only poorly to the part to be coated, the application of a permanently adhering varnish can take place in a two-stage process. In a first step, a primer, which produces a chemical or physical bond between the polymer part and the topcoat, is applied. After the application and curing of the primer, the functional layer can be applied. In addition to coloring compounds and pigments, the functional layer and the primer can also contain UV blockers and preservatives, as well as components to increase scratch resistance, for instance, nanoparticles. In many cases, the primer applied first contains UV blockers and preservatives. Then, in a second step, the hardcoat is applied on the primer. Hardcoats contain, in many cases, hybrid polysiloxanes, which contain both Si—O groups and Si—R groups with organic residues —R. These hardcoats have a high resistance to mechanical stress and aggressive chemical substances or compounds. This includes, primarily, organic solvents but also diluted acids and bases.

The varnish consisting of primer and topcoat can be applied using various methods. Commonly used methods include brushing and rolling, spraying of aerosols, powder coating, dip coating, and flow coating of solutions, emulsions, or suspensions, as well as CVD (chemical vapor deposition) and PVD (physical vapor deposition) methods from the gas phase. The methods differ significantly in their equipment requirements, costs, and, in particular, in the case of large quantities, their reproducibility. A common method for varnishing polymeric materials in large quantities is flow coating. For this, a component is impinged on from the upper edge with a liquid varnish. The resultant coating can occur with one or a plurality of fixedly mounted flow-coat nozzles or a varnish curtain or with a movable flow robot arm. The varnish running down wets the entire component depending on the position of the flow robot arm.

A disadvantage of flow coating is the physically created coating thickness gradient from the point of the varnish application or the upper onflow edge and the lower drip edge of the excess varnish. On its path over the component to be coated, a part of the solvent evaporates. The decrease in solvent concentration results, in many cases, in an increase in viscosity of the varnish in the region of the drip edge. The increase in viscosity simultaneously reduces the drip speed and also simultaneously causes an increase in the layer thickness in the region of the drip edge. In addition, prepolymerized and partially polymerized portions of the varnish can accumulate and back up in the region of the drip edge. In the onflow region, the required layer thickness is frequently not reached; whereas, at the drip edge, due to the continuing flow of the varnish, an excessive layer thickness can develop. An inadequate layer thickness can result in loss of weather resistance and, thus, in rapid aging of the coated component. In contrast, an excessive layer thickness of the varnish frequently causes stress crack formation. This effect is intensified when multiple varnish layers or functional layers are applied on the part to be coated.

DE 199 06 247 A1 discloses a method for production of a two-layer topcoat on motor vehicle bodies. A transparent final coat made of a clear varnish coating material is applied on a water-based base coat.

GB 1,097,461 A discloses a method for printing and dyeing plastic sheets or films. The dye can be applied by brushing, spraying, or flow coating and then fixed by drying.

GB 1,201,292 A discloses an acrylic coating for wood, glass, plastic, and synthetic vehicle body parts that can be cured at low temperatures. The acrylic coating can be applied by spraying, dipping, brushing, or flow coating.

GB 2 123 841 A discloses a thin, abrasion resistant polyurethane coating that can be applied to the material by dip coating and flow coating methods. Possible substrates are, among others, transparent polycarbonates and thermoplastic polyurethane sheets.

WO 2008/134768 A1 discloses a method for flow coating a polymeric material. The coating is applied at a predetermined coating angle.

The object of the invention is to provide a method for flow coating a polymeric material that makes a uniform layer thickness of the layers of varnish applied possible on the component to be coated. In particular, the layer thickness gradient of the varnish should be as small as possible from the upper onflow edge to the lower drip edge.

The object of the present invention is accomplished according to the invention by a method for flow coating a polymeric material according to claim 1. Preferred embodiments are given by the subclaims.

A device according to the invention for flow coating and its use emerge from the other independent claims.

The method according to the invention for flow coating a polymeric material comprises a first step, wherein at least one component is inserted at an angle of 25° to 90° relative to the floor into a holder. The component is then coated from an upper edge with a varnish that contains 10 wt.-% to 30 wt.-%, preferably 15 wt.-% to 20 wt.-% of 4-methyl-2-pentanone and/or derivatives thereof. The varnish flows from the upper edge over the component all the way to the drip edge. Depending on the size of the component to be coated, the varnish flows onto the component from a varnish curtain and/or from a plurality of nozzles arranged next to each other. In another option, the varnish is applied on the component from a movable nozzle arm.

The rapidly evaporating solvent 4-methyl-2-pentanone significantly promotes the film formation, in that it stops the flow dynamic of the coating early and thus counteracts film shrinkage in the area of the upper edge due to excessively long continued flow of the varnish as well as increased varnish build up on the lower edge due to accumulation of varnish. In this manner, a homogeneous layer thickness is obtained in the Y direction along the component surface. Experiments have yielded an increase in layer thickness in the area of the upper edge (to roughly 30% of the length of the component from the upper edge) by 2-10% and a decrease in layer thickness in the region of the lower edge (to roughly 30% of the length of the component from the lower edge) of 2-10%.

In a preferred embodiment, the varnish below the upper edge of the component is impinged on by a stream of air simultaneously and/or while the varnish flows on the component. In the context of the invention, the expression "below the upper edge" includes up to 30% of the surface adjacent the edge of the component. The impingement by the stream of air on at least subregions within the region below the upper edge increases the evaporation of the solvents in the varnish and increases the viscosity of the varnish. The increased viscosity slows the flow of the varnish in the region below the upper edge and equalizes the layer thickness of the varnish below the upper edge with the layer thickness of the varnish on the lower drip edge.

In an alternative embodiment of the method according to the invention for flow coating a polymeric material, in a first step, at least one component is inserted at an angle of 25° to 90° relative to the floor into a holder. Then, the component is heated on an upper edge to a temperature of 25° C. to 100° C. and, in the meantime and/or thereafter, coated from the upper edge with the varnish. The expression "upper edge" refers, as described above, to 30% of the surface of the component adjacent the edge. The heating of the upper edge can be carried out with a hot stream of air or an air blower. An alternative option is heating using radiant heat, for instance, with an infrared radiator. The heating of the component below the upper edge increases, as with impingement by a stream of air, the evaporation of the solvents in the varnish and increases the viscosity of the varnish. The increased viscosity slows the flow of the varnish in the region below the upper edge and equalizes the layer thickness of the varnish below the upper edge (onflow edge) with the layer thickness of the varnish on the lower drip edge.

The two embodiments of the method according to the invention described can also be repeated in an automated process. The repetition of the application of varnish as well as the impingement by a stream of air or the heating of the component enables the deposition of a plurality of the same and/or different varnish layers. The repetition can take place both on the same device and also on different devices according to the invention connected to each other by a conveyor belt.

The component is preferably inserted at an angle of 35° to 70°, particularly preferably 40° to 60°, relative to the floor into the holder. The holder contains preferably metals and/or alloys, particularly preferably iron, aluminum, chromium, vanadium, nickel, molybdenum, manganese, or polymers such as polyethylene, polypropylene, polystyrene, polyurethanes, polycarbonates, polymethyl methacrylates, polyacrylates, polyesters, polyamides, and/or mixtures or copolymers thereof.

The stream of air preferably has a speed of 1 m/s to 5 m/s, preferably 2 m/s to 4 m/s.

The stream of air preferably has a temperature of 30° C. to 150° C., preferably of 40° C. to 80° C.

The invention further includes a device for flow coating a polymeric material. The device comprises at least one component inserted at an angle of 25° to 90° relative to the floor into a holder. The component contains at least one polymeric material; in addition, the component can also contain a metal and/or glass. The polymeric material preferably contains polyethylene, polypropylene, polystyrene, polyurethanes, polycarbonates, polymethyl methacrylates, polyacrylates, polyesters, polyamides, polyethylene terephthalate, and/or mixtures or copolymers thereof, particularly preferably polycarbonate and polycarbonate blends, such as polycarbonate/polyethylene terephthalate; polycarbonate/acrylonitrile butadiene styrene; polycarbonate/polybutylene terephthalate. The component preferably has a surface of more than 250 $cm^2$, particularly preferably more than 500 $cm^2$. A nozzle, preferably a movable robot arm, is disposed above the component to apply varnish on the component. The nozzle or the movable robot arm enables application of the varnish on the upper edge relative to the floor and 30% of the surface of the component adjacent the edge. An air nozzle and/or heat source is aimed at the upper edge of the component. Depending on the size and width of the component, a plurality of air nozzles and/or heat sources can also be disposed next to each other.

The holder is preferably installed on a conveyor belt, a floor conveyor, or a suspension conveyor. The conveyor belt is preferably situated within a varnish line and thus enables flow coating of large quantities of components and multiple varnishing steps.

The air nozzle or air gun is preferably disposed at a distance of 100 mm to 1000 mm, preferably 150 mm to 400 mm, from the component in the temporarily stationary (parked) state.

Preferably 1 to 10 air nozzles, particularly preferably 2 to 5 air nozzles, are disposed in front of the component.

The varnish contains preferably a topcoat and/or a primer, particularly preferably organically modified silicone resins in the topcoat and/or polyacrylates in the primer.

The varnish preferably contains solvents, preferably water, alcohols, and/or ketones, particularly preferably methanol and, 2-propanol, n-butanol, 1-methoxy-2-propanol, 4-hydroxy-4-methyl-2-pentanone, and/or mixtures or derivatives thereof.

The primer contains solvents, preferably 1-methoxy-2-propanol, 4-hydroxy-4-methyl-2-pentanone, and/or mixtures or derivatives thereof. The topcoat contains solvents, preferably water, particularly preferably methanol, 2-propanol, n-butanol, and/or mixtures or derivatives thereof.

The invention further includes the use of the device according to the invention for flow coating polymeric materials, preferably for flow coating plastic parts in motor vehicles, particularly preferably for flow coating motor vehicle roofs and/or automobile glazings made of plastic.

In the following, the invention is explained in detail with reference to drawings. The drawings are purely schematic and are not true to scale. The drawings in no way restrict the invention.

Figure 2:
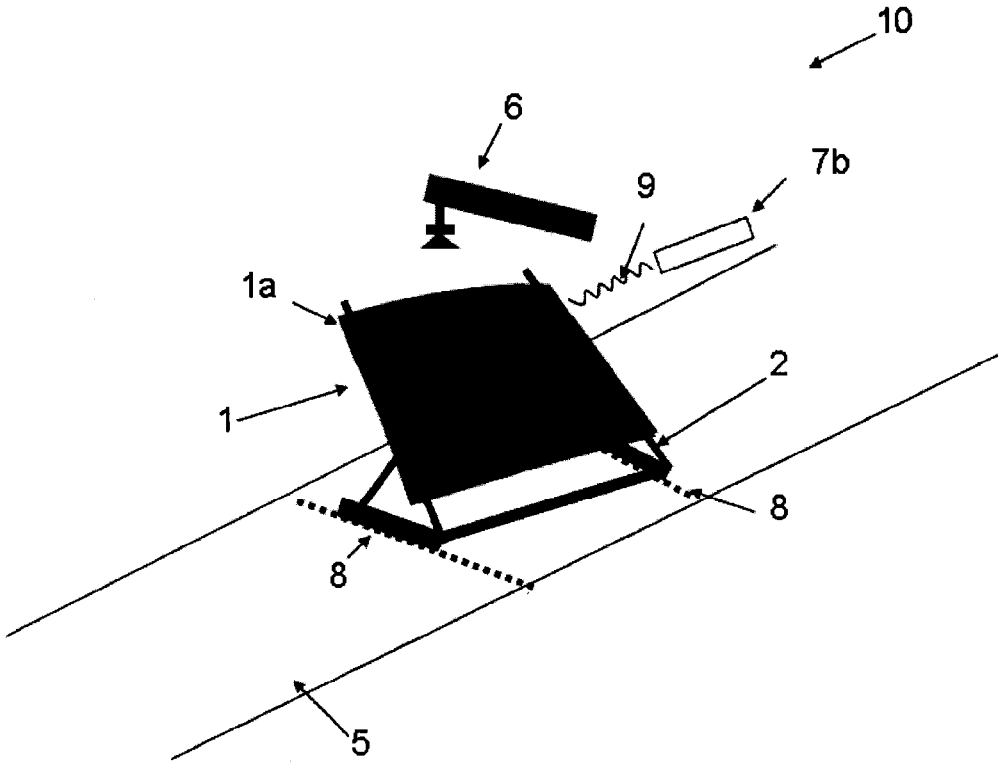
Figure 3:
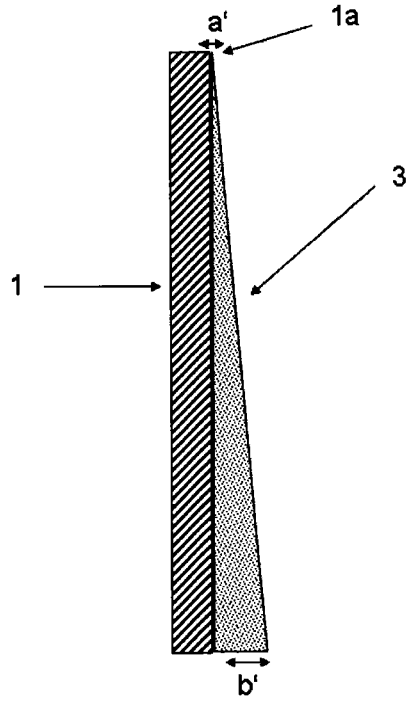
FIG. 3 PRIOR ART
Figure 4:
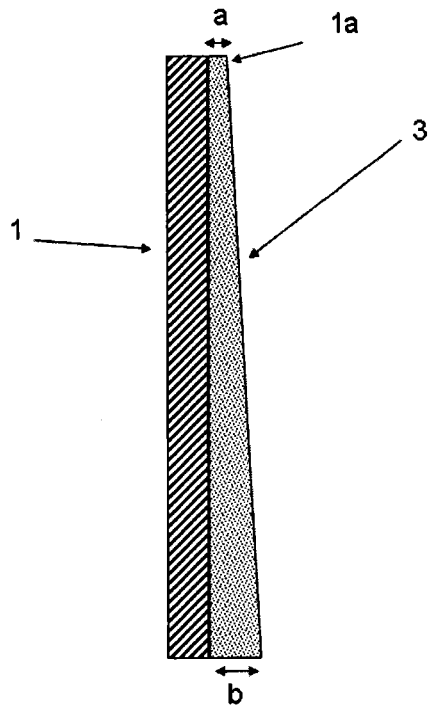

They depict:

FIG. 1 a schematic view of one embodiment of the device according to the invention, FIG. 2 a schematic view of another embodiment of the device according to the invention, FIG. 3 a cross-section of a flow coated component of the prior art, and FIG. 4 a cross-section of the flow coated component in accordance with the method according to the invention.

FIG. 1 is a schematic view of a preferred embodiment of the device (10) according to the invention. The component to be coated (1) is situated in a holder (2) and is coated by a movable nozzle arm (6) from the upper edge (1*a*) of the component (1) with varnish (3). In the region within the upper edge (1*a*) of the component (1), i.e., 30% of the surface adjacent the edge, the varnish (3) is impinged on by a stream of air (4) from an air nozzle (7*a*). The holder (2) is preferably situated on floor conveyors (8). The floor conveyors (8) on the floor (5) enable use of the device (10) according to the invention in the direction of movement (11) in varnish lines and assembly lines.

FIG. 2 is a schematic view of a another preferred embodiment of the device (10) according to the invention. The basic structure corresponds to the structure of the device described in FIG. 1. However, in the region of the upper edge, the component is heated before or during the application of varnish (3) (not shown) by a heat source (7*b*). The solvent in the varnish (3) evaporates faster in the heated region and thus produces a higher viscosity and layer thickness (a) on the upper edge (1*a*). The conveyor belts (8) on the floor (5) enable, as also in FIG. 1, the use of the device (10) according to the invention in varnish lines and assembly lines.

FIG. 3 depicts a cross-section of a flow coated component according to the prior art. The component (1) was flow coated from the upper edge (a') to the drip edge (b'). Part of the solvent in the varnish (3) evaporates while flowing over the component (1). This effect is all the greater, the longer the component (1) and the higher the ambient temperature. The decrease in solvent in the varnish (3) causes an increase in the viscosity of the varnish (3) and, thus, a disadvantageous increase in the varnish layer thickness in the region of the drip edge (b').

FIG. 4 depicts a cross-section of a flood coded component according to the inventive method. The component (1) was flow coated from the upper edge (a) to the drip edge (b) and the varnish (3) was, in the meantime, impinged on below the upper edge (1*a*) of the component (1) by a stream of air (4). Part of the solvent in the varnish (3) evaporates while flowing over the component (1); this is, as described in FIG. 3, all the greater, the longer the component and the higher the ambient temperature. However, The impingement by a stream of air (4) increases the evaporation of the solvent of the varnish (3) on the upper edge (a). The resultant higher viscosity increases the layer thickness of the varnish (3) on the upper edge (a) and ensures a smaller difference relative to the layer thickness of the varnish (3) on the drip edge (b). Compared to flow coating with a device according to FIG. 3, the mean layer thickness of the upper edge (1*a*) increases by 3% to 5% with a device and method according to the invention.

LIST OF REFERENCE CHARACTERS (1) Component
(1*a*) Upper edge of the component
(2) Holder
(3) Varnish
(4) Stream of air
(5) Floor
(6) Nozzle/Spray arm
(7*a*) Air nozzle
(7*b*) Heat source
(8) Conveyor belt/Floor conveyor
(9) Heat radiation
(10) Device according to the invention
(11) Direction of movement
(a, a') Upper edge/Onflow edge, and
(b, b') Drip edge

The invention claimed is:

1. A method for flow coating a component, the method comprising:

inserting the component into a holder at an angle of 25° to 90° relative to a floor; and coating the component from an upper edge with a varnish comprising 10 wt.-% to 30 wt.-% of 4-methyl-2-pentanone and/or a derivative of 4-methyl-2-pentanone, wherein the component comprises a polymeric material; and wherein the method further comprises:

impinging on greater than 0 and up to 30% of a surface of the component adjacent to the upper edge with a stream consisting essentially of air during the coating of the component, and/or maintaining greater than 0% and up to 30% of a surface of the component adjacent to the upper edge at a temperature of 25° C. to 100° C. before and/or during the coating of the component.

2. The method of claim 1, comprising impinging on greater than 0 and up to 30% of a surface of the component adjacent to the upper edge with a stream consisting essentially of air during the coating of the component.

3. The method of claim 2, wherein the stream consisting essentially of air has a speed of 1 m/s to 5 m/s.

4. The method of claim 3, wherein the stream consisting essentially of air has a speed of 2 m/s to 4 m/s.

5. The method of claim 4, wherein the stream consisting essentially of air has a temperature of 40° C. to 80° C.

6. The method of claim 2, wherein the stream consisting essentially of air has a temperature of 30° C. to 150° C.

7. The method of claim 6, wherein the stream consisting essentially of air has a temperature of 40° C. to 80° C.

8. The method of claim 1, comprising maintaining greater than 0 and up to 30% of a surface of the component adjacent to the upper edge at a temperature of 25° C. to 100° C. before and/or during the coating of the component.

9. The method of claim 1, further comprising repeating the coating at least once after at least 30 s and before or at 120 s.

10. The method of claim 1, wherein the component is inserted at an angle of 35° to 70° relative to the floor into the holder.

11. The method of claim 10, wherein the component is inserted at an angle of 40° to 60° relative to the floor into the holder.

12. The method of claim 1, wherein the varnish comprises a topcoat, a primer, or a mixture thereof.

13. The method of claim 12, wherein the topcoat, the primer, or the top coat and the primer comprises an organically modified silicone resin, a polyacrylate, or a mixture thereof.

14. The method of claim 1, wherein the varnish further comprises a solvent in addition to the 4-methyl-2-pentanone and/or derivative of 4-methyl-2-pentanone.

15. The method of claim 14, wherein the solvent is water, an alcohol, a phenol, a ketone, or any mixture thereof.

16. The method of claim 15, wherein the solvent is ethanol, methanol, 2-propanol, n-butanol, 1-methoxy-2-propanol, 4-hydroxy-4-methyl-2-pentanone, or any mixture thereof.

* * * * *